US005101732A

United States Patent [19]

Schluckebier

[11] Patent Number: 5,101,732

[45] Date of Patent: Apr. 7, 1992

[54] FULL METAL JACKET HOLLOW POINT BULLET AND METHOD OF MAKING A FULL METAL JACKET HOLLOW POINT BULLET

[75] Inventor: David K. Schluckebier, Florissant, Mo.

[73] Assignee: Olin Corporation, Cheshire, Conn.

[21] Appl. No.: 679,475

[22] Filed: Apr. 2, 1991

[51] Int. Cl.[5] ..... F42B 12/34

[52] U.S. Cl. ..... 102/509; 102/514

[58] Field of Search ..... 102/507–510, 102/514–516

[56] References Cited

U.S. PATENT DOCUMENTS

| | | | |
|---|---|---|---|
| 2,327,950 | 8/1943 | Whipple | 102/507 |
| 3,157,137 | 4/1963 | Burns | 102/91 |
| 3,349,711 | 10/1967 | Darigo | 102/91 |
| 4,044,685 | 8/1971 | Avon | 102/508 |
| 4,550,662 | 11/1985 | Burczynski | 102/509 |
| 4,610,061 | 6/1985 | Halverson | 102/509 |

FOREIGN PATENT DOCUMENTS

| | | | |
|---|---|---|---|
| 17996 | of 1898 | United Kingdom | 102/514 |
| 4426 | of 1899 | United Kingdom | 102/508 |

*Primary Examiner*—Harold J. Tudor
*Attorney, Agent, or Firm*—John R. Wahl

[57] ABSTRACT

A full metal jacket hollow point bullet is disclosed which has the jacket extending fully within the hollow open front end of the bullet. A plurality of radial slits through the jacket within the hollow front end extend from the axis to the mouth of the hollow front end. These slits form prongs therebetween which project outward upon upset of the bullet in soft tissue.

1 Claim, 2 Drawing Sheets

FULL METAL JACKET HOLLOW POINT BULLET AND METHOD OF MAKING A FULL METAL JACKET HOLLOW POINT BULLET

BACKGROUND OF THE INVENTION

This invention generally relates to bullets and more particularly to a small caliber projectile having a hollow point and a full metal jacket.

Jacketed bullets are well known in the art. The bullet typically is made of a lead alloy and has a jacket typically made of a copper alloy and covers at least part of the ogive and the cylindrical body portions of the bullet. This type of jacketed bullet gives a more controlled expansion in soft body tissue than an unjacketed lead bullet. Further expansion can be obtained upon initial target penetration by providing a hollow in the front end of the bullet. The front end may also be formed with cuts and/or ribs in the jacket or with cuts or ribs in the core within the hollow tip to further control the expansion upon upset of the bullet is soft tissue.

One typical hollow point jacketed bullet is disclosed in U.S. Pat. No. 3,157,137, assignied to the assignee of the present invention. This patent discloses a jacketed bullet with a rosette type of hollow point formed entirely from the open jacket end. Another is U.S. Pat. No. 3,349,711 which has external cuts in the ogive portion of the full metal jacket around the hollow tip. Another example is U.S. Pat. No. 4,550,662. In this patent, the hollow tip is formed with axially extending ribs in the soft metal core.

Another hollow point jacketed bullet, using aluminum for the jacket, is disclosed in U.S. Pat. No. 4,610,061, assignied to the assignee of the present invention. In this patent, the jacket extends only part way into the hollow and cuts are made in the jacket at the rim of the hollow point.

All of these bullets provide relatively predictable curling back of the jacket upon upset of the bullet in soft tissue. The petals formed by the jacket segments peeling back curl beyond 180°, folding under the expanding head of the bullet, along the cylindrical portion thereof. Thus the cutting swath in soft tissue is generally determined by the outer diameter of the expanded head of the upset bullet.

Maximum expansion of the head is desirable to maximize hemorrhaging and tissue damage. This maximized expansion maximizes the lethality in game animals. However, if the head expands too much, the bullet will separate into segments which limits the penetration. Accordingly, to obtain significant depth of penetration, the mass of the bullet must remain behind the head.

SUMMARY OF THE INVENTION

It is an object of the invention to provide a bullet which has an increased effective head diameter upon upset.

It is another object of the invention to provide a bullet which causes improved tissue damage in soft body tissue without separation.

It is another object of the invention to provide a jacketed bullet which produces outwardly directed jacket prongs upon upset.

It is a further object of the invention to provide a jacketed bullet with improved lethality.

It is a still further object of the invention to provide an upset jacketed bullet which has curled back jacket petals terminating in outwardly curled prongs.

The full metal jacketed bullet in accordance with the invention is a generally cylindrical jacketed body with a generally ogival front end having an open hollow tip. The bullet in accordance with the invention has a malleable metal core symmetrical about a central axis therethrough and has an open cavity in the front end fully covered by a metal jacket following the internal contour of the open cavity. The portion of the metal jacket in the cavity has a plurality of spaced axial slits radiating from the central axis and extending through the jacket thickness.

These slits cause the jacket to peel back upon upset in soft tissue in spaced petals. Further, the portions of the jacket between the slits form sharp pointed prongs at the ends of the petals as they unfold during the mushrooming of the bullet on entry into soft tissue. The prongs unfold last as the ogival front end of the bullet expands to form the mushroomed head. These prongs end up extending and curving outward from the bullet body instead of curving under the mushroom head as in conventionally designed bullets.

Since the bullet is rotating as it enters soft body tissue of a target animal, the effective head diameter is increased substantially by the prongs thus increasing substantially the cutting swath of the upset bullet. In addition, the upset bullet lodged within soft tissue will continue to cause hemorrhaging and further internal damage to the animal as the animal moves due to these outwardly directed prongs. This will hasten the demise of the injured animal and hence increase the lethality of the bullet.

DETAILED DESCRIPTION OF THE INVENTION

Figure 1:
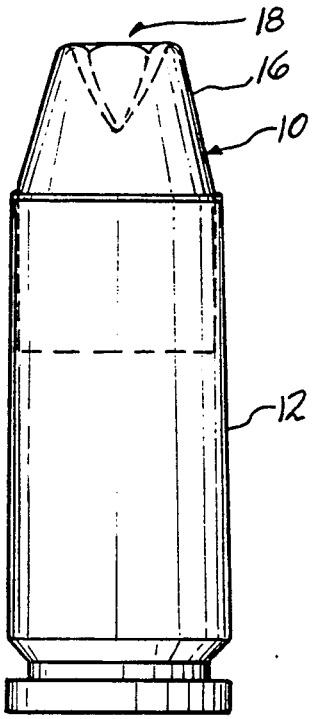
FIG. 1 is a side elevational view of a cartridge containing the bullet in accordance with the invention.
Figure 2:
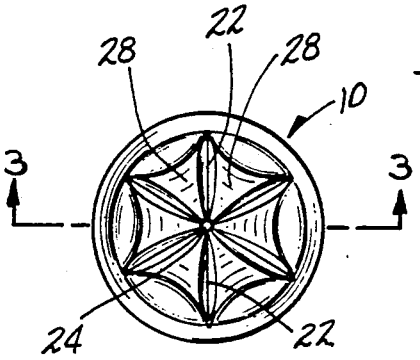
FIG. 2 is an end view of the bullet of the invention removed from the cartridge case in FIG. 1.
Figure 3:
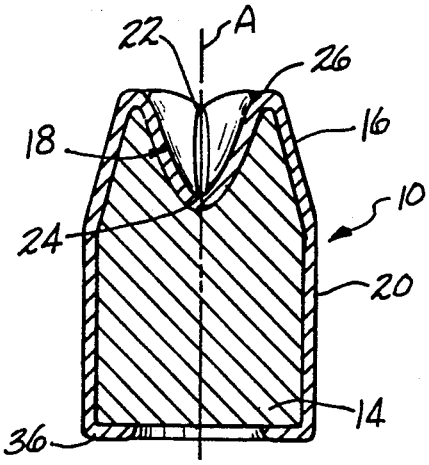
FIG. 3 is a longitudinal cross sectional view of the bullet of the invention taken along the line 3—3 in FIG. 2.

A full metal jacket hollow point bullet 10 constructed in accordance with the invention is shown loaded into a cartridge case 12 in FIG. 1 and separately in FIGS. 2 and 3.

Bullet 10 has a generally cylindrical core body portion 14, a generally ogival front end portion 16, and a hollow open cavity 18 axially extending into the front end portion 16. The core portions 14 and 16 are preferably formed of a malleable metal such as lead or a lead alloy.

A full metal jacket 20 covers at least a major portion of the cylindrical body portion 14, all of the ogival front end portion 16 and extends fully into the hollow cavity 18 so as to enclose the front end portion. The jacket is made of a malleable metal such as a copper or copper alloy.

A plurality of radial slits 22 in the jacket extend through the wall thickness of the jacket 20 and extend axially from the apex 24 of the cavity 18 inside the cavity to the mouth 26 of the cavity. The portions of the jacket in the cavity 18 thus form pointed jacket prongs 28 between the slits 22 which converge at the apex 24 on the central axis A.

The front end portion 16 is preferably frustoconical in shape. The cavity 18 may have a curved profile or may have a generally conical profile having a straight sidewall. The choice depends on the caliber and the precision of the tooling necessary to form the cavity. Each prong 28 may be joined with the other prongs at the apex 24 or may be separated, again, depending on the precision of the tooling forming the slits in the jacketed core.

Figure 4:
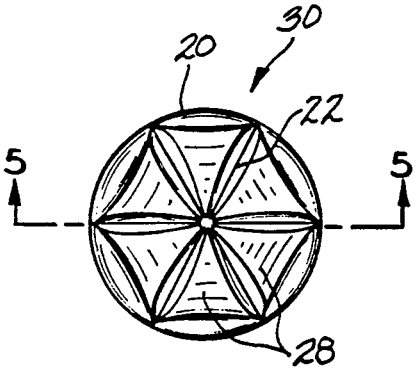
FIG. 4 is an end view of a jacketed bullet core prior to forming the ogival nose portion of the bullet shown in FIGS. 1 through 3.
Figure 5:
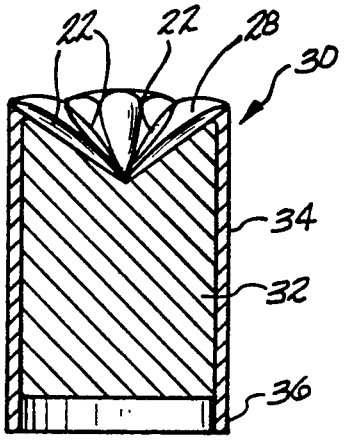
FIG. 5 is a longitudinal sectional view of the jacketed core taken along the line 5—5 in FIG. 4.

The bullet 10 is formed from a jacketed blank 30 shown in FIGS. 4 and 5. A cylindrical blank 32 of lead is swaged or molded inside a flat bottomed cup shaped jacket blank 34. A conical punch having radially spaced cutting ridges is then pressed against the flat bottom of the jacket blank 30 to form a conical indent with radial slits 22 through the jacket 20 in the bottom of the blank 30. This indented blank is then forced into a conical cavity of a forming tool to constrict the bottom of the jacketed blank 30 to form the generally frustoconical front end portion 16 having the open cavity 18 with the converging prongs 28 as is shown in FIGS. 1 through 3. At the same time, the rear end 36 of the jacket blank 34 is crimped over the rear of the bullet core 32 so as to securely capture and lock the bullet core 32 within the jacket.

Thus the method of forming the full jacketed hollow point bullet 10 in accordance with the invention having an ogival front end portion 16 with a forwardly open cavity 18 therein comprises the steps of:

a) drawing a sheet metal blank into a cup shaped jacket blank 34 having a continuous flat bottom and a generally uniform thickness wall;

b) forming a malleable metal core 32 in the cup shaped jacket blank 34 against said bottom by swaging or molding the core directly into the blank;

c) indenting said bottom of said jacket blank;

d) cutting a plurality of radial slits 22 through the jacket wall in the indented bottom either separately or simultaneously with steps (b) and (c) above; and e) forcing the end of the blank 30 containing the core against the indented bottom of the blank into a concave cavity of a forming tool to deform the end of the blank into an ogival front end portion 16 of the bullet 10 and the bottom into an open cavity 18 with the slits 22 through the jacket 20 remaining in the open cavity 18.

Finally, the rear end 36 of the blank 30 is crimped over the rear of the core 32 to lock it in place and ensure that the core 32 remains fully inserted within the the ogival end portion 16.

Figure 6:
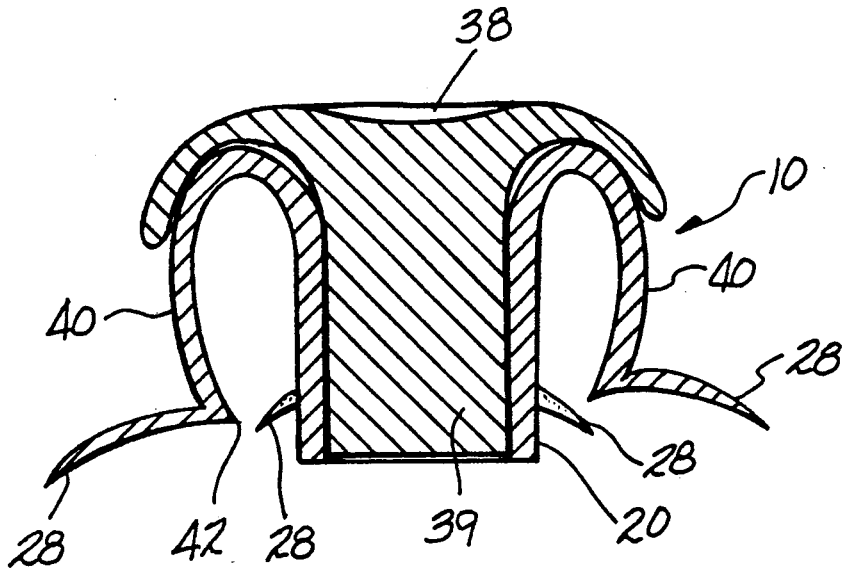
FIG. 6 is a sectional view of an upset bullet in accordance with the invention.
Figure 7:
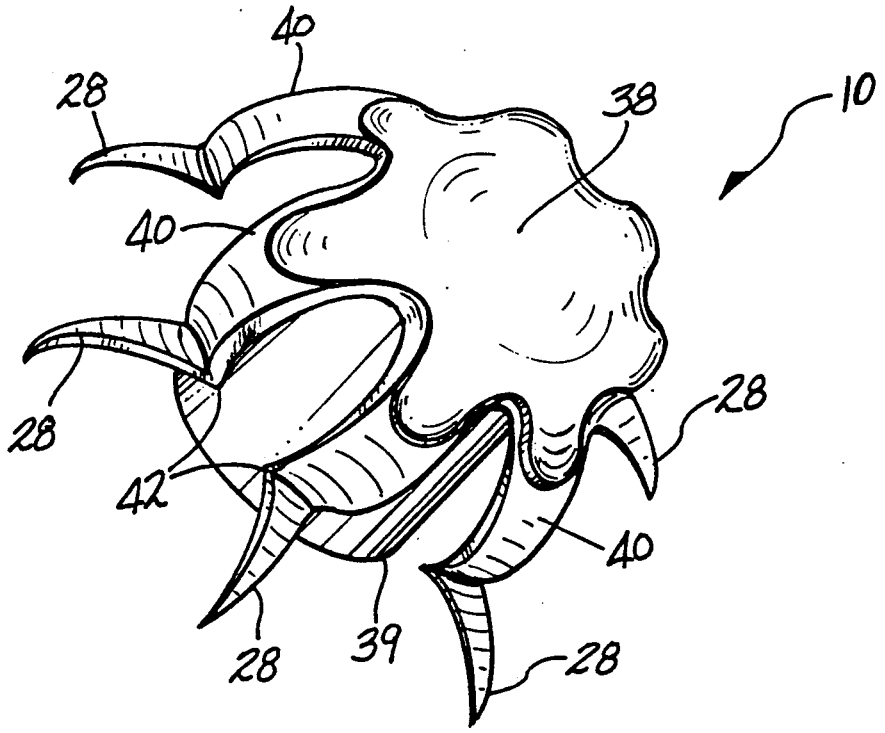
FIG. 7 is a perspective view of the upset bullet of the invention shown in FIG. 6.

FIGS. 6 through 7 illustrate the mushrooming of the bullet 10 of the invention and the unfolding of the prongs 28 when the bullet of the invention is fired into soft body tissue. The upset bullet 10 forms a mushroomed head 38 in front of a generally cylindrical body portion 39 as the soft lead is forced forward and out during penetration and deceleration.

The prongs 28 separate radially as the head 38 forms causing the front end of the jacket to split and form petals 40 which are folded back. These petals 40 provide support for the prongs and cause them to extend outward from the folding petals 40. Each prong projects from a transition region 42 of the petal 40 corresponding originally to the jacket material at the mouth 26 of the cavity 18. This transition is a region of work hardened metal occuring because of the work hardening which takes place during constriction of indented end of the blank 30 to form the frustoconical front end portion 16.

The upset bullet 10 shown in FIGS. 6 and 7 results from penetration into soft body tissue. The soft body tissue is here simulated by penetration in gelatin. The angle and curvature at which the prongs 28 extend outward from the body portion upon upset will depend on several factors, such as projectile velocity and particular jacket alloy characteristics.

In the illustrated embodiment, the jacket was draw formed from a cup shaped blank. The blank was made from gilding metal which is a brass alloy conforming to ASTM B36. The bullet core of lead alloy is swaged into the draw formed cup shaped blank. The 10 mm finished bullet was conventionally inserted into a 10 mm case loaded with 5.2 grains of Bullseye® No. 2 propellant powder (by Hercules Powder Co.).

Five test rounds were fired from a Colt model Delta Elite automatic pistol into a standard gelatin test module from a distance of about 10 feet at a velocity of about 950 feet per second. The gelatin test module was 6" by 6" by 18". The five resultant upset bullets retreived from the test modules all exhibited the structure as shown in FIGS. 6 and 7.

The invention has been shown and described with reference to one preferred embodiment, other variations and modifications are contemplated as being within the scope of the invention. For example, different jacket thicknesses and alloy compositions may be utilized and different numbers of slits 22 cut in the jacket. In addition, the cavity 18 and the mouth 26 may be differently shaped which will change the work hardening of the jacket at the region of the mouth 26 and therefore the position of the transition region 42 and shape of the prongs 28 may be selectively varied. Accordingly it is intended to embrace all such variations and modifications as defined by the scope of the appended claims. All patents, patent applications and other references referred to herein are hereby incorporated by reference in their entirety.

What is claimed is:

1. A bullet comprising:

a malleable metal body symmetrical about an axis therethrough, said body having a recess in one end forming an open cavity having a mouth and a pointed apex centered on said axis;

a metal jacket over a major portion of said body completely enclosing said one end and said recess, said jacket extending fully into said one end, said jacket in said end having a plurality of radially spaced slits forming petals therebetween in said jacket extending only from said pointed apex to said mouth, said petals each having a hardened transition region about said mouth and a pointed prong terminating at said pointed apex, said transition region being harder than any other portion of said bullet jacket and said body.

* * * * *